US006292145B1

(12) United States Patent
Yu

(10) Patent No.: US 6,292,145 B1
(45) Date of Patent: Sep. 18, 2001

(54) ANGLED ANTENNA FOR PORTABLE TELEPHONE

(76) Inventor: Sun Yu, 2850 Coolidge, Berkley, MI (US) 48072

( * ) Notice: Subject to any disclaimer, the term of this patent is extended or adjusted under 35 U.S.C. 154(b) by 0 days.

(21) Appl. No.: 09/496,838

(22) Filed: Feb. 2, 2000

(51) Int. Cl.[7] ..... H01Q 1/24
(52) U.S. Cl. ..... 343/702; 343/895
(58) Field of Search ..... 343/702, 900, 343/895, 888; H01Q 1/24

(56) References Cited

U.S. PATENT DOCUMENTS

| | | | |
|---|---|---|---|
| 2,417,793 | 3/1947 | Wehner . | |
| 3,151,328 | 9/1964 | Boyer | 343/742 |
| 3,488,657 | 1/1970 | Pressel et al. | 343/708 |
| 4,313,119 | 1/1982 | Garay et al. | 343/702 |
| 4,516,127 | 5/1985 | Siwiak | 343/702 |
| 4,584,585 | 4/1986 | Marko et al. | 343/702 |
| 4,641,366 | 2/1987 | Yokoyama et al. | 455/89 |
| 5,022,861 | 6/1991 | Aoto | 439/13 |
| 5,336,896 | 8/1994 | Katz | 250/515.1 |
| 5,365,246 | 11/1994 | Rasinger et al. | 343/702 |
| 5,588,041 | 12/1996 | Meyer, Jr. et al. | 379/59 |
| 5,590,416 | 12/1996 | Rydbeck | 455/90 |
| 5,850,612 | 12/1998 | Kulberg et al. | 455/550 |
| 5,909,653 | 6/1999 | Imura et al. | 455/575 |
| 5,926,748 * | 7/1999 | Yoshihara et al. | 343/702 |
| 5,990,848 * | 11/1999 | Annamaa et al. | 343/702 |

* cited by examiner

*Primary Examiner*—Michael C. Wimer
(74) *Attorney, Agent, or Firm*—Gifford, Krass, Groh, Sprinkle, Anderson & Citkowski, P.C.

(57) ABSTRACT

An antenna for a portable telephone is angled rearward relative to a plane defined by the earpiece face. The antenna is durable owing to the fixed position and decreases user exposure to electromagnetic radiation. The rearward angle of the antenna is between and 10 and 80°.

12 Claims, 1 Drawing Sheet

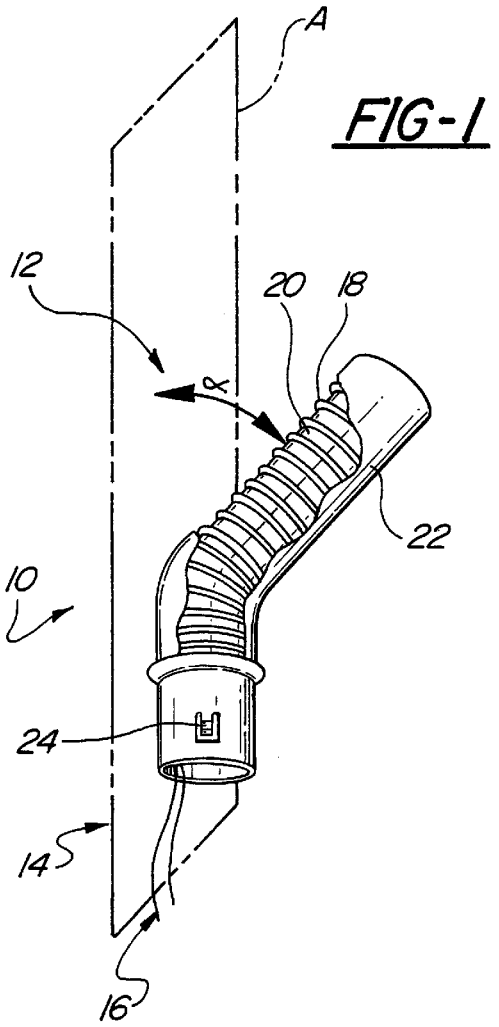
FIG-1
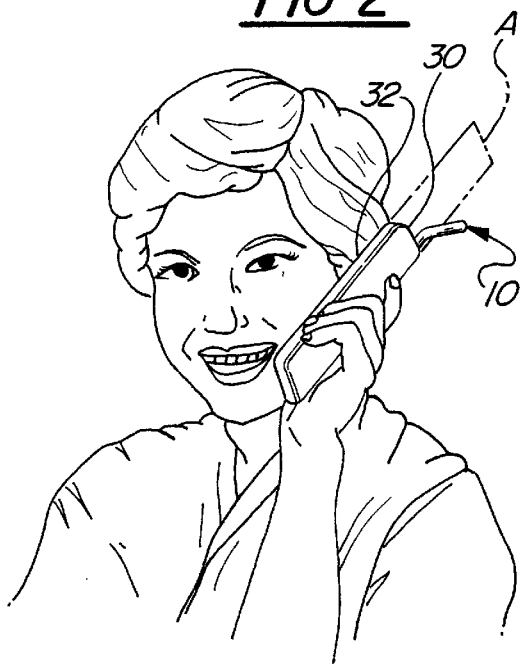
FIG-2
FIG-3A
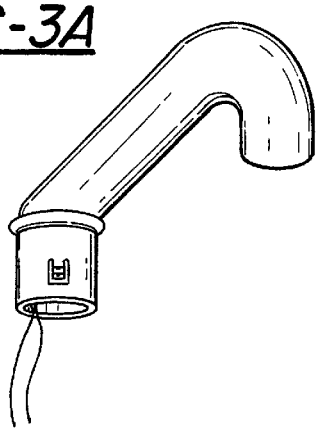
FIG-3B
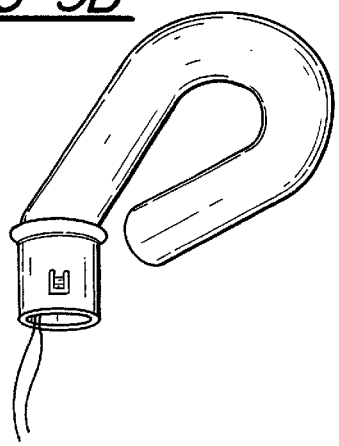

ANGLED ANTENNA FOR PORTABLE TELEPHONE

FIELD OF THE INVENTION

The present invention relates to a portable telephone and, more particularly, a fixed, angled antenna for portable telephones.

BACKGROUND OF THE INVENTION

A conventional portable telephone has an antenna for communicating to a cellular base station by way of radio signals. The antenna is typically a half-wave dipole antenna mounted on the exterior of the portable telephone. The length of the half-wave or quarter-wave dipole being dictated by the operating radio-frequency. For example, a portable telephone operating in the 800 to 900 MHz frequency range has a half-wave dipole approximately 85 mm in length. The half-wave size dipole antenna can effectively be decreased by winding the element around a structurally stable core to reduce the relative size of the antenna with respect to the portable telephone body.

Another antenna configuration includes two or more antenna resonators parasitically coupled together and oriented parallel to one another. Each parallel antenna resonator being anchored conductively to a shielding housing while the other end serves as a free resonator. Thus, antenna elements are configured to form "inverted-F or -L antennas" as detailed in U.S. Pat. No. 5,365,246 as well as the references cited therein.

While prior art linear antennas extending from either the side or top portions of a telephone housing and parallel to the long axis of a portable telephone achieve considerable signal gain, as do the inverted-F and -L antennas, there is a growing concern that the electromagnetic radiation emanating from portable telephones and associated antennas may have deleterious effects on neural function and health.

The increasing availability of portable telephones as well as the close contact of the telephone and associated antenna with an individual's head exacerbate these concerns. Considerable dosimetry over prolonged periods of time results owing to the proximity to the head and the regular exposure to electromagnetic radiation associated with portable telephones.

Since electromagnetic radiation intensity decreases as the reciprocal square of distance from the emanation source, antennas have been devised which can be swung into a position away from the portable telephone earpiece to a position nonparallel with the primary axis of the portable telephone. U.S. Pat. Nos. 5,777,261; 5,590,416 and PCT Publication WO 98/09342 are examples thereof. While these antennas serve to reduce electromagnetic radiation exposure to the head of a user by extending the antenna away from a user head, this is achieved by an antenna having at least two antenna positions. Typically, these antennas rotate or fold proximal to the portable telephone housing as an inactive position and rotate away from the user head and non-parallel to the primary axis of the portable telephone body in an active position. Such antennas have a limited operational lifetime owing to the regular stresses placed on the pivot about which the antenna position is varied. Thus, there exists a need for an antenna which reduces electromagnetic radiation exposure to a user's head through a permanently bent antenna.

SUMMARY OF THE INVENTION

The present invention includes an antenna for portable telephones including a nonconductive core having a bent portion and a connector portion such that the bent portion extends generally rearward from the face of the portable telephone at an angle of between 10 and 80° relative to the long axis defined by the telephone body. The connector portion of the antenna is adapted to be received within an antenna receptacle of the portable telephone. A metallic antenna element is wrapped about the nonconductive core.

The present invention has utility in providing adequate communication reception while lessening electromagnetic radiation exposure associated with an antenna being adjacent to a user's head during operation. The stationary bent structure of an antenna according to the present invention is durable owing to the omission of movable elements to displace the antenna between operational and nonoperational orientations.

BRIEF DESCRIPTION OF THE DRAWINGS

A preferred constructional form of the present invention is shown in the appended drawings by way of example, and is not intended as a limitation on the invention or its equivalents as defined in the appended claims.

FIG. 1 is a partial cutaway perspective view of an embodiment of the present invention;

FIG. 2 is a perspective view of the antenna depicted in FIG. 1 integrated into a conventional portable telephone; and FIGS. 3A–B are perspective views of alternate embodiments of the present invention.

DETAILED DESCRIPTION OF THE INVENTION

With reference to FIGS. 1 and 2, a fixed orientation antenna 10 is depicted having a bent portion 12 and a portable telephone connector portion 14. Antenna 10 is energized at the lower end of the connector portion 14 by way of transmission lines 16 which are in electrical contact with a portable telephone power supply (not shown) and a ground where the transmission line 16 connects to a wound metal antenna element 18 wound about a non-conductive core 20. Preferably, the core 20 is formed of a single injection molded plastic material. The core 20 and the metallic antenna element 18 are overlaid with a protective layer 22. The protective over layer 22 preferably being a resinous or thermoplastic material. The protective layer 22 being applied by conventional means including dip coating, spray coating, extrusion and the like. The antenna 10 includes a fastener 24 selected to be complementary to a fastener securing fixture contained within a portable telephone antenna receptacle. It is appreciated that the fastener 24 as well as the connector shape and dimensions 14 are selected to be compatible with a given portable telephone design.

A bent portion of an antenna according to the present invention is optionally adapted to form an inverted "V" shape operative as a hook, FIG. 3A. Alternatively, the bent portion is in the form of an eyelet, FIG. 3B, suited for securing a looped flexible member thereto. The hook or eyelet serving as means for maintaining the telephone about a user or user's clothing. A metallic antenna element need not extend the length of the hook or eyelet portion.

An antenna 10 according to the present invention is adapted to engage a conventional portable telephone 30 by way of the connector 14 and fastener 24 such that the bent portion 12 extends rearward from telephone face 32. The telephone face includes a keypad, speaker and a mouthpiece (not shown). By the bent portion 12 of the antenna 10 according to the present invention facing generally rearward, the present invention takes advantage of the squared reciprocal distance decrease in electromagnetic radiation. While is appreciated that the bent portion 12 of the antenna 10 can be bent at a rearward angle relative to the plane A generally defined by the telephone earpiece face 30, the angle $\alpha$ between the plane A and the bent portion 12 of the antenna 10 is chosen between 10 and 80°. Preferably, $\alpha$ is between 30 and 60°. More preferably, $\alpha$ is between 40 and 50°. $\alpha$ is chosen to decrease electromagnetic radiation exposure while keeping the portable telephone footprint from becoming awkwardly large, which is associated with small and large values of $\alpha$, respectively. It is appreciated that the length of the bent portion 12 is in part dictated by the metallic antenna element 18 length which, in turn, is dictated by the operating frequency of the portable telephone.

Publications mentioned in the specification are indicative of the levels of those skilled in the art to which the invention pertains. These publications are incorporated herein by reference to the same extent as if each individual publication was specifically and individually incorporated herein by reference.

The foregoing description is illustrative of particular embodiments of the invention, but is not meant to be a limitation upon the practice thereof. The following claims, including all equivalents thereof, are intended to define the scope of the invention.

What is claimed is:

1. An antenna for a portable telephone having a face and a body comprising:

a non-retractable non-conductive core having a bent portion and a connector portion wherein the bent portion extends generally rearward from the portable telephone face at an angle of between 10 and 80° relative to a plane defined by the telephone earpiece and the connector portion is adapted to be received within an antenna receptacle of the portable telephone, wherein the bent portion and the connector portion are not relatively movable; and a metallic antenna element wrapped about said core.

2. The antenna of claim 1 further comprising a protective layer in contact with said metallic antenna element.

3. The antenna of claim 1 further comprising a fastener adapted to secure within the portable telephone antenna receptacle.

4. The antenna of claim 1 wherein the angle is between 30 and 60°.

5. The antenna of claim 4 wherein the angle is between 40 and 50°.

6. The antenna of claim 1 wherein the bent portion is formed in the shape of a hook.

7. The antenna of claim 1 wherein the bent portion is formed in the shape of an eyelet.

8. An improved antenna for a portable telephone, the antenna angled away from the long axis of the telephone during operation to reduce electromagnetic radiation exposure adjacent to an earpiece of the telephone wherein the improvement lies in: the antenna being non-retractable and having a fixed angled bend rearward from the earpiece at an angle relative to the long axis of between 10° and 80°, said antenna having a bent portion and a connector portion adapted to be received within an antenna receptacle of the portable telephone, wherein the bent portion and the connector portion are not relatively movable.

9. The improvement of claim 8 further comprising the antenna being shaped as a hook.

10. The improvement of claim 8 further comprising the antenna being shaped as an eyelet.

11. The improvement of claim 8 wherein the angle is between 30° and 60°.

12. A method of receiving cellar communications with a portable telephone with a fixed orientation bent non-retractable antenna having a rearward angle of between 10 and 80° relative to a plane defined by an earpiece face of the portable telephone, said antenna having a bent portion and a connector portion adapted to be received within an antenna receptacle of the portable telephone, wherein the bent portion and the connector portion are not relatively movable.

* * * * *